US005851070A

United States Patent [19]

Dobreski et al.

[11] Patent Number: 5,851,070

[45] Date of Patent: Dec. 22, 1998

[54] SEALS FOR PLASTIC BAGS

[75] Inventors: David V. Dobreski; Steve P. Long, both of Fairport, N.Y.

[73] Assignee: Tenneco Packaging Inc., Evanston, Ill.

[21] Appl. No.: 759,616

[22] Filed: Dec. 5, 1996

[51] Int. Cl.[6] ..... B65D 33/16

[52] U.S. Cl. ..... 383/63; 428/516; 428/523; 525/240

[58] Field of Search ..... 428/516, 523; 525/240; 383/63

[56] References Cited

U.S. PATENT DOCUMENTS

| | | | |
|---|---|---|---|
| 4,808,561 | 2/1989 | Welborn, Jr. | 502/104 |
| 4,871,523 | 10/1989 | Datta et al. | 423/265 |
| 4,871,705 | 10/1989 | Hoel | 502/117 |
| 4,925,318 | 5/1990 | Sorensen | 383/63 |
| 4,925,821 | 5/1990 | Change | 502/107 |
| 4,937,301 | 6/1990 | Chang | 526/128 |
| 4,971,454 | 11/1990 | Branson et al. | 383/61 |
| 5,001,205 | 3/1991 | Hoel | 526/128 |
| 5,004,356 | 4/1991 | Matsui | 383/63 |
| 5,006,500 | 4/1991 | Chang | 502/107 |
| 5,007,142 | 4/1991 | Herrington | 24/400 |
| 5,007,143 | 4/1991 | Herrington | 24/400 |
| 5,010,627 | 4/1991 | Herrington et al. | 24/400 |
| 5,017,021 | 5/1991 | Simonsen et al. | 383/63 |
| 5,017,655 | 5/1991 | Kase et al. | 525/127 |
| 5,020,194 | 6/1991 | Herrington et al. | 24/400 |
| 5,026,798 | 6/1991 | Canich | 526/127 |
| 5,032,652 | 7/1991 | Chang | 526/129 |
| 5,050,736 | 9/1991 | Griesbach et al. | 206/484 |
| 5,063,069 | 11/1991 | Van Erden et al. | 426/122 |
| 5,063,644 | 11/1991 | Herrington et al. | 24/400 |
| 5,067,208 | 11/1991 | Herrington, Jr. et al. | 24/400 |
| 5,070,194 | 12/1991 | Sasoka et al. | 540/214 |
| 5,070,583 | 12/1991 | Herrington | 24/400 |
| 5,079,205 | 1/1992 | Canich | 502/117 |
| 5,084,534 | 1/1992 | Wilborn, Jr., et al. | 526/160 |
| 5,088,971 | 2/1992 | Herrington | 493/203 |
| 5,124,418 | 6/1992 | Welborn Jr. | 526/114 |
| 5,131,121 | 7/1992 | Herrington, Jr. et al. | 24/436 |
| 5,152,613 | 10/1992 | Herrington, Jr. | 383/63 |
| 5,161,286 | 11/1992 | Herrington, Jr. et al. | 24/387 |
| 5,183,867 | 2/1993 | Welborn, Jr. | 526/114 |
| 5,185,909 | 2/1993 | Inagaki | 24/587 |
| 5,188,461 | 2/1993 | Sorensen | 383/63 |

(List continued on next page.)

FOREIGN PATENT DOCUMENTS

| | | | |
|---|---|---|---|
| 0 566 363 A1 | 10/1993 | European Pat. Off. . | |
| 600 425 A1 | 6/1994 | European Pat. Off. | B32B 27/32 |
| 0 801 003 A2 | 10/1997 | European Pat. Off. . | |
| WO 94/25271 | 11/1994 | WIPO | B32B 27/08 |
| WO 94/26816 | 11/1994 | WIPO | C08L 23/08 |
| WO95/29604 | 11/1995 | WIPO . | |
| WO95/35046 | 12/1995 | WIPO . | |
| WO95/35047 | 12/1995 | WIPO . | |
| WO95/35048 | 12/1995 | WIPO . | |

OTHER PUBLICATIONS

Schut, Jan H., "Competition for Metallocenes Could Turn Ugly," *Plastics World* (Jan. 1995), pp. 33–36.

*Primary Examiner*—David W. Wu
*Attorney, Agent, or Firm*—Arnold, White & Durkee

[57] ABSTRACT

The present invention improves performance of the side and/or fin seals of plastic bags through the use of resins that have a narrow molecular weight distribution or polydispersity. The performance of the side seal and/or fin seal of a plastic bag is improved by using body panels which comprise a first resin, and optionally, a second resin. The first resin is preferably prepared in the presence of a single site catalyst. The first resin has a polydispersity of from about 1 to about 4, a melt index of from about 0.2 to about 20, and a melt flow ratio ($I_{20}/I_2$) of from about 12 to about 35. The use of such first resins results in side and fin seals which are stronger, tougher, and less likely to leak. The second resin is a polymer such as LDPE, LLDPE, or a blend thereof In body panels comprising both a first and a second resin, the first resin may be coextruded with LDPE or LLDPE as a thin layer of the body panel or the first resin may be blended with the LDPE and/or LLDPE.

45 Claims, 2 Drawing Sheets

U.S. PATENT DOCUMENTS

| | | | |
|---|---|---|---|
| 5,189,764 | 3/1993 | Herrington et al. | 24/387 |
| 5,206,075 | 4/1993 | Hodgson, Jr. | 428/216 |
| 5,238,306 | 8/1993 | Heintz et al. | 383/61 |
| 5,272,236 | 12/1993 | Lai et al. | 526/348.5 |
| 5,273,809 | 12/1993 | Simmons | 428/212 |
| 5,279,693 | 1/1994 | Robinson et al. | 156/272.8 |
| 5,283,932 | 2/1994 | Richardson et al. | 24/400 |
| 5,301,394 | 4/1994 | Richardson et al. | 24/400 |
| 5,301,395 | 4/1994 | Richardson et al. | 24/400 |
| 5,330,269 | 7/1994 | Kamada et al. | 383/210 |
| 5,358,792 | 10/1994 | Mehta et al. | 428/516 |
| 5,380,810 | 1/1995 | Lai et al. | 526/352 |
| 5,382,631 | 1/1995 | Stehling et al. | 525/240 |
| 5,405,478 | 4/1995 | Richardson et al. | 156/308.4 |
| 5,415,904 | 5/1995 | Takubo et al. | 428/35.2 |
| 5,426,830 | 6/1995 | Richardson et al. | 24/430 |
| 5,431,760 | 7/1995 | Donovan | 156/66 |
| 5,442,837 | 8/1995 | Morgan | 24/400 |
| 5,442,838 | 8/1995 | Richardson et al. | 24/402 |
| 5,448,807 | 9/1995 | Herrington, Jr. | 24/399 |
| 5,448,808 | 9/1995 | Gross | 24/400 |
| 5,482,375 | 1/1996 | Richardson et al. | 383/64 |
| 5,669,715 | 9/1997 | Dobreski et al. | 383/5 |
| 5,682,730 | 11/1997 | Dobreski | 53/469 |

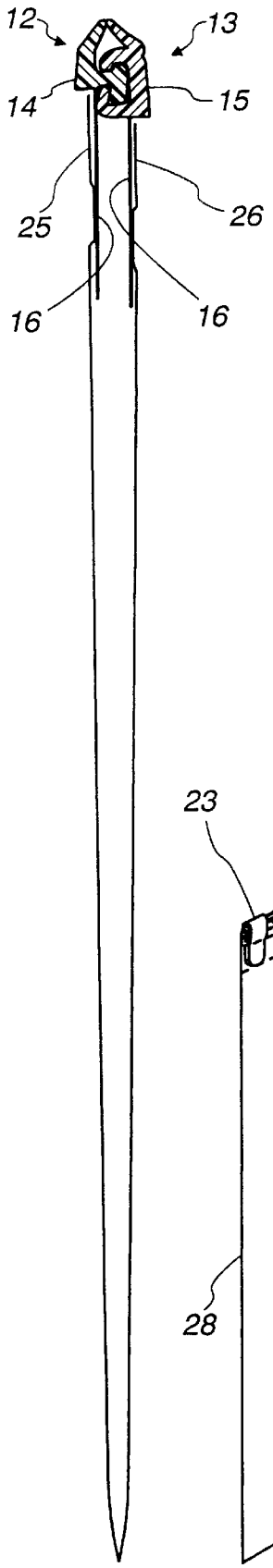
Fig. 3
Fig. 1
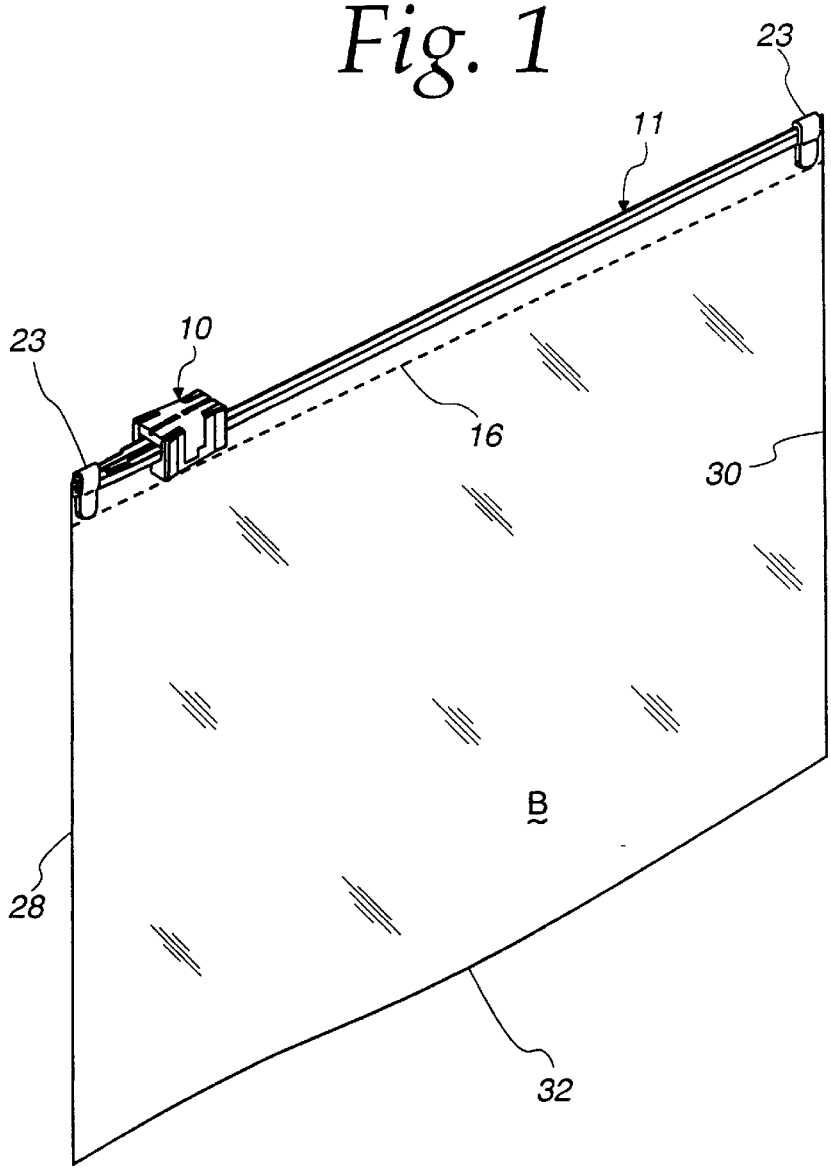

SEALS FOR PLASTIC BAGS

FIELD OF THE INVENTION

The present invention relates generally to plastic bags. More particularly, the present invention relates to the use of particular polymers in food bags to strengthen the seals of the bag.

BACKGROUND OF THE INVENTION

The use of plastic bags is becoming increasingly more common in the marketplace. However, a significant factor affecting their acceptance and range of application is the strength and reliability of the seals of the bag.

Plastic bags are in widespread use in a varied and diverse number of household and commercial applications. Plastic bags typically include at least one type of seal (the "side seal") which seals a first body panel to a second opposing body panel along sides of the plastic bag. A plastic bag may also include a second type of seal (the "fin seal") which is created when a plastic fin is used to attach a zipper-type closure mechanism to the body panels. The popularity of these bags has placed increased demands on the tasks they are asked to perform and, as a result, current bags are susceptible to failure of the side and fin seals.

Consequently, a need exists for both side seals and fin seals that are able to withstand increased force and more adverse conditions.

SUMMARY OF THE INVENTION

It is an object of the present invention to provide plastic bags with side seals and fin seals that are able to withstand greater forces than previous plastic bags.

The present invention improves performance of the side and/or fin seals of plastic bags through the use of resins that have a narrow molecular weight distribution or polydispersity ($M_w/M_n$ or MWD). The performance of the side seal and/or fin seal of a plastic bag is improved by using body panels which comprise a first resin, and optionally, a second resin. The first resin is preferably prepared in the presence of a single site catalyst and has a polydispersity of from about 1 to about 4, a melt index of from about 0.2 to about 20, and a melt flow ratio ($I_{20}/I_2$) of from about 12 to about 35. The use of first resins in the body panels results in side and fin seals which are stronger, tougher, and less likely to leak. Examples of first resins are linear low density polyethylene (LLDPE) and metallocene-catalyzed LLDPE. The second resin is a polymer such as low density polyethylene (LDPE), LLDPE, or a blend thereof In body panels comprising both a first and a second resin, the first resin may be coextruded with a second resin as a thin layer of the body panel or the first resin may be blended with the second resin. Preferably, the body panels are formed entirely of the first resin. In one embodiment, a thin layer of the first resin is coextruded with at least one of the following: LDPE resin, LLDPE resin, or a LDPE/LLDPE blend. The term "layer" as used herein shall include any coating, film, lamination, coextrusion or the like.

BRIEF DESCRIPTION OF THE DRAWINGS

FIG. 1 is a perspective view of a plastic bag having a fastener and slider;

FIG. 3 is a cross-sectional view taken generally along the lines 3—3 in FIG. 2.

Figure 2:
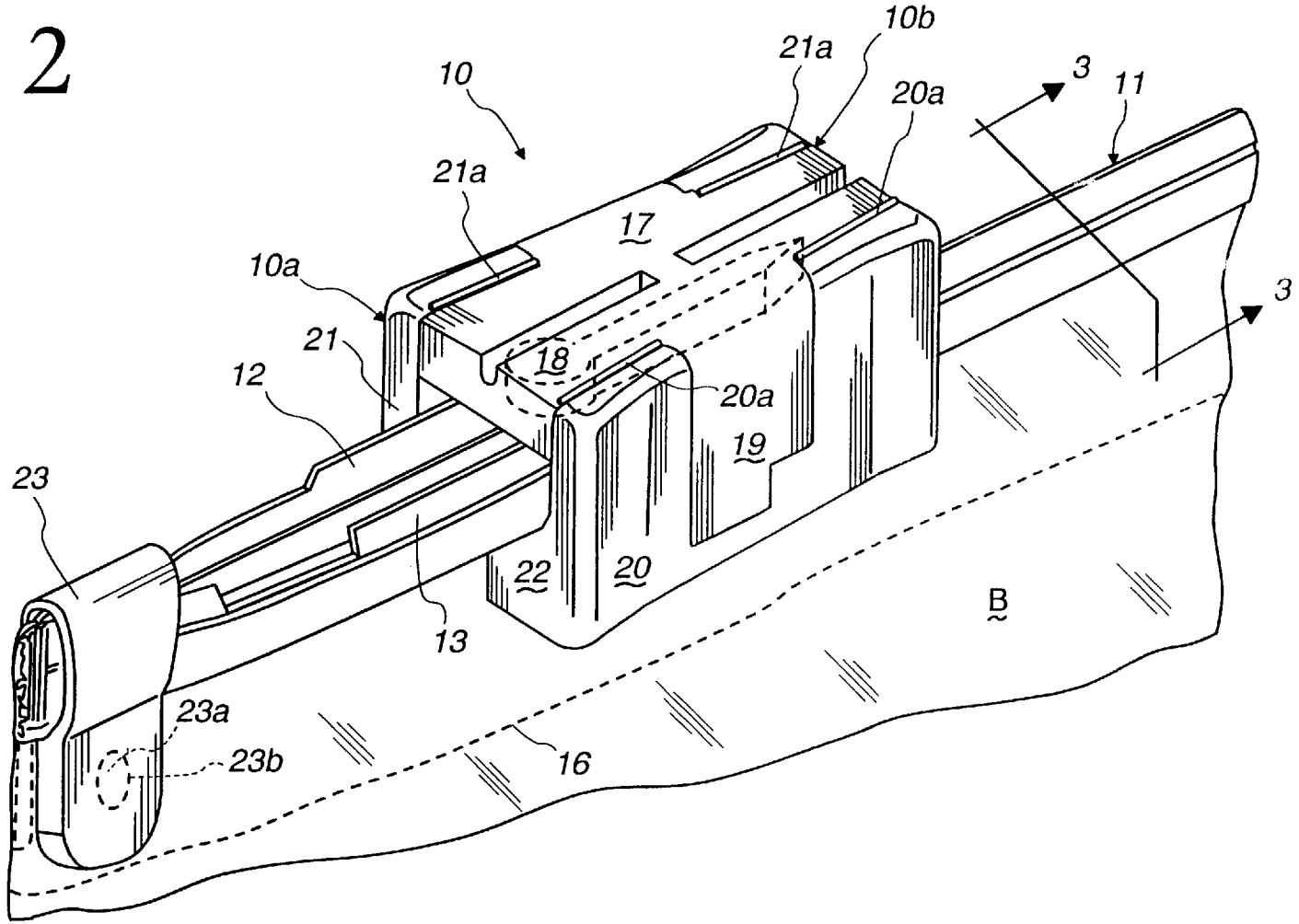
FIG. 2 is an enlarged perspective view of the fastener and slider of FIG. 1 in assembled position on a thermoplastic bag.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

In one embodiment, the bag B (as shown in FIGS. 1 and 3) is formed from a single flexible plastic sheet folded upon itself and comprises first and second opposing body panels 25 and 26. Body panels 25 and 26 are fixedly connected to each other along a pair of sides 28 and 30 and a bottom 32 which extends between the pair of sides 28 and 30. In this embodiment, Bag B preferably has a profiled plastic reclosable fastener or zipper 11 extending along a mouth formed opposite the bottom 32 of Bag B, in which the zipper 11 has a male track 12 and a female track 13. The slider 10 and zipper 11 are particularly suited for thermoplastic bags and the like. Slider 10 has been illustrated in FIG. 2 assembled on the zipper 11 at the top edge or mouth of a thermoplastic bag B. The plastic slider 10 and the profiled zipper 11 cooperate to close the bag B.

As shown in FIGS. 2 and 3, tracks 12 and 13 have interlocking male and female profiles 14 and 15 extending the length thereof in the form of rib and groove elements on the respective tracks. The tracks 12 and 13 may be extruded separately with a fin and attached to the respective sides of the bag mouth or the tracks 12 and 13 may be extruded integral with the sides of the bag mouth. If the tracks 12 and 13 are extruded separately, they are most effectively attached by means of a respective first and second fin 16, incorporated within the tracks, that is heat sealed to the bag mouth. The male and female profiles 14 and 15 have complementary cross-sectional shapes and are closed by pressing a bottom of the elements together first and then rolling the elements to a closed position toward the top thereof. The cross-sectional shapes of the interlocking male and female profiles 14 and 15 are the subject of the invention claimed in U.S. Pat. No. 5,007,143, which is incorporated herein by reference.

As may be seen in FIG. 2, the slider 10 straddles the zipper 11 at the top of the bag B and is adapted for opening or closing the interlocking tracks 12 and 13 of the zipper 11. The slider 10 may be molded from any suitable plastic such as, for example, nylon, polypropylene, polyethylene, polystyrene, Delrin or ABS.

In this embodiment, shown in FIG. 2, the slider 10 comprises an inverted U-shaped member including a transverse support member or body 17 from which the separator finger 18 extends downward. The body 17 is itself U-shaped and includes two integral legs 19 extending downward. The finger 18 is positioned between the legs 19. The body 17 is adapted to move along the top edges of the tracks 12 and 13 with the legs 19 straddling these elements and the finger 18 positioned between the tracks 12 and 13. The slider 10 also includes a pair of hinged "wings" 20 and 21 that can be folded down into their final position. The wings 20 and 21 are hinged to the main slider body 17 by means of hinge structures 20*a* and 21*a* located at the opposite ends of the legs 19.

The foldable depending wings or side walls 20 and 21 extend from an opening end 10*a* of the slider 10 to a closing end 10*b*. It will also be noted that the main slider body 17 and the separator finger 18 are wider at the opening end 10*a* than at the closing end 10*b*. Similarly, the side walls 20 and 21 and the legs 19 are spaced wider apart at the opening end 10*a* of the slider 10 to permit separation of the male and female profiles 14 and 15 by the finger 18 engaging the tracks 12 and 13. The wings 20 and 21 and legs 19 are spaced sufficiently close together at the closing end 10*b* of the slider to press the male and female profiles 14 and 15 into an interlocking relationship as the slider 10 is moved in a fastener closing direction. As shown in FIG. 2, the side walls 20 and 21 at their lower ends are provided with an inwardly extending shoulder structure 22. Shoulder structure 22 engages a bottom of the zipper 11 to prevent slider 10 from being lifted off the edges of the tracks 12 and 13 while the slider 10 straddles the zipper 11.

The opposite ends of the zipper 11 are provided with end termination clips 23. Each of the end clips 23 is identical and is best shown in FIG. 2. Each end clip 23 comprises a strap member which wraps over the top of the zipper 11. One end of the strap is provided with a rivet like member 23*a* which is adapted to penetrate through the bag material and into a cooperating opening 23*b* at the other end of the clip 23. The rivet 23*a* is then deformed so as to create a head locked into the opening 23*b*.

The body panels 25 and 26 of the present invention comprise at least one resin which imparts superior side seal and fin seal strength to the body panels 25 and 26 when heat sealed together. These body panels 25 and 26 after sealing possess superior side seal and fin seal strength to that of the control low density polyethylene (LDPE) body panels. The first resin is comprised of a copolymer prepared, preferably, in the presence of a single-site catalyst with ethylene and at least one alpha olefin monomer, e.g,. a copolymer or terpolymer. The alpha olefin monomer generally has from 3 to about 12 carbon atoms, preferably from 4 to 10 carbon atoms, and more preferably from 6 to 8 carbon atoms. The alpha olefin comonomer content is generally below about 30 weight percent, preferably below about 20 weight percent, and more preferably from about 1 to about 15 weight percent. Exemplary comonomers include propylene, 1-butene, 1-pentene, 1-hexene, 3-methyl-1-pentene, 4-methyl-1-pentene, 1-octene, 1-decene, and 1-dodecene.

The average molecular weight of the first resin can generally range from about 20,000 to about 500,000, preferably from about 50,000 to about 200,000. The molecular weight is determined by commonly used techniques such as size exclusion chromatography or gel permeation chromatography. The first resin has a polydispersity within the range of from about 1 to about 4, preferably from about 1.5 to about 4, more preferably from about 2 to 4, and even more preferably from 2 to 3. The first resin has a ratio of the third moment to the second moment, $M_z/M_w$, is generally below 2.3, preferably below 2.0, and more typically from about 1.6 to about 1.95. The melt flow ratio (NMR) of these resins, defined as $I_{20}/I_2$ and determined in accordance to ASTM D-1238, is generally from about 12 to about 35, preferably from about 14 to about 35, and more preferably from about 15 to about 18. The melt index (MI), defined as the $I_2$ value, should be in the range of from about 0.2 to about 20, and preferably from about 1 to about 17. The first resin has a density of from about 0.85 to about 0.94 g/cm$^3$, preferably from about 0.88 to about 0.925 g/cm$^3$, and more preferably from about 0.88 to about 0.920 g/cm$^3$.

Resin materials which may be used for the first resin are available from, among others, Dow Chemical Company and Exxon Chemical Company which produce single site or constrained geometry catalyzed polyethylenes. These resin materials are commercially available as the AFFINITY and EXXACT polyethylenes (see *Plastics World*, pp. 33–36, Jan. 1995), and also as the ENHANCED POLYETHYLENE and EXCEED line of resins. The polyethylenes include at least the following: LLDPE, ultra low density polyethylene and very low density polyethylene. The manufacture of such polyethylenes, generally by way of employing a metallocene catalyst system, is set forth in, among others, U.S. Pat. Nos. 5,382,631, 5,380,810, 5,358,792, 5,206,075, 5,183,867, 5,124,418, 5,084,534, 5,079,205, 5,032,652, 5,026,798, 5,017,655, 5,006,500, 5,001,205, 4,937,301, 4,925,821, 4,871,523, 4,871,705, and 4,808,561, each of which is hereby incorporated herein by reference in its entirety. These catalyst systems and their use to prepare such resin materials are also set forth in EP 0 600 425 A1 and PCT applications WO 94/25271 and 94/26816. The polyethylene resins produced generally have a crystalline content in excess of at least 10 weight percent, generally in excess of at least 15 weight percent. In a preferred embodiment metallocene catalysts are utilized, but other catalysts, such as single-site catalysts, are available as equivalent substitutes.

The above patents and publications generally report that these metallocene catalysts contain one or more cyclopentadienyl moieties in combination with a transition metal. The metallocene catalyst may be represented by the general formula $C_cMA_aB_b$ wherein C is a substituted or unsubstituted cyclopentadienyl ring; M is a Group 3–10 metal or Lanthanide series element, generally a Group IVB, VB, or VIB metal; A and B are independently halogens, hydrocarbyl groups, or hydrocarboxyl groups having 1–20 carbon atoms; a =0–3, b=0–3, and c=1–3. The reactions can take place in either gas phase, high pressure, slurry, or solution polymerization schemes.

The body panels 25 and 26 of the present invention are preferably constructed entirely of a first resin, i.e., of polymers having a narrow molecular weight distribution. The body panels 25 and 26 may also be constructed from a combination of the first resin with a second resin material. The body panels 25 and 26 which comprise the first resin may contain the first resin in an amount ranging from at least about 5 weight percent to 100 weight percent. Other ranges contemplated include the first resin ranging from at least 5 weight percent to about 50 or about 75 weight percent. At the present time, however, from an economic viewpoint it is more desirable to have the body panels 25 and 26 comprise from about 5 weight percent to about 25 weight percent first resin, and most preferably from at least about 10 to about 15 weight percent first resin.

The second resin material is preferably a linear low density polyethylene (LLDPE) resin having a density from about 0.89 to about 0.94 g/cm$^3$, a LDPE resin having a density from about 0.88 to about 0.935 g/cm$^3$ or a blend of the LLDPE and LDPE resins. LLDPE is generally prepared by polymerizing ethylene with a comonomer which preferably has from 4–10 carbon atoms and more preferably 6–8 carbon atoms.

The first resin and the second resin may be incorporated into a body panel in a number of ways. Second resins, such as LDPE and LLDPE resins or the LDPE/LLDPE blend, may be blended with the first resin prior to extrusion so as to create a multicomponent body panel. Further, in a preferred embodiment, a thin layer of the first resin is coextruded with the LDPE or LLDPE resins or the LDPE/LLDPE blend. Additional resins are also contemplated, such as having a first resin coextruded with both the LDPE and LLDPE resins.

The present invention is equally effective in body panels having a number of layers. The body panels 25 and 26 do not need to be composed of a single layer made in accordance with this disclosure. It is possible to incorporate any number of layers of varying and unlimited composition into a single body panel. The objects of increasing seal and fin integrity are met if at least one of these layers is made in accordance with the present invention. Preferably, that layer is composed of metallocene-catalyzed polyethylene and is placed on the inside of the body panel such that it is in direct contact with a similar layer of the opposing body panel during the heat sealing process. However, a layer of the present invention not in direct contact with the opposing body panel and comprising at least 5 weight percent of the body panel would also achieve increased seal and fin integrity.

Either or both of the outside surfaces of the body panels can be treated by such known and conventional post-forming operations as corona discharge, chemical treatment, flame treatment, etc., to modify the printability or ink receptivity of the surface(s) or to impart other desirable characteristics thereto.

The following example illustrates the effectiveness of the present invention in creating stronger side and fin seals.

EXAMPLE

Plastic bags with body panels composed of metallocene-catalyzed polyethylene coextruded with LDPE were tested and compared to control plastic bags having body panels made of LDPE. The coextruded body panels of the inventive bags were composed of 6–10 total weight % metallocene-catalyzed polyethylene. The metallocene-catalyzed polyethylene of the inventive bags had a density of 0.900, a polydispersity of 2.0, a melt index of 7.5, and a melt flow ratio of 17. The metallocene-catalyzed polyethylene layers were on the insides of the body panels and in direct contact with each other. The metallocene-catalyzed polyethylene layer was composed of 60–100 weight % metallocene-catalyzed polyethylene. The LDPE used in the control and the inventive bags had a density of 0.924 g/cm$^3$, a polydispersity of 7.5, a melt index of 2.1, and a melt flow ratio of 143.

The first test consisted of measuring side seal and fin seal strength with an Instron 1130 tensile strength tester. One inch strips containing either the side seal or the fin seal were placed in the Instron. The pounds of force to tear the seal and the percent elongation before tearing were then measured.

The second test consisted of placing 8 ounces of water in one gallon bags and then rotating the bags so that the water remained in contact with each side seal and corner for at least five seconds. The second test was performed in approximately 15–20 seconds. Leak rates were recorded.

The results of the tests are illustrated in the Table:

TABLE

| Bag Composition | Side Seal Strength (avg. lbs.) | Side Seal Elongation (avg %) | Fin Seal Strength (avg. lbs.) | Fin Seal Elongation (avg. %) | Leak Rates (avg. %) |
|---|---|---|---|---|---|
| Coextruded Metallocene/ LDPE | 9.3 | 183 | 5.9 | 616 | 0 |
| LDPE | 5.9 | 75 | 5.5 | 504 | 66 |

The metallocene-catalyzed inventive bags displayed significant improvements over the LDPE control bags in both side and fin seal strength and side and fin seal elongation. 66% percent of the LDPE control bags leaked, while none of the metallocene-catalyzed inventive bags leaked.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A plastic bag comprising:

first and second body panels each having a top, a bottom, and first and second opposing sides, said first and second panels being joined to each other along their respective bottoms, their respective first opposing sides, and their respective second opposing sides, wherein at least one of said first and second panels comprises at least two co-extruded polymeric film layers, a first layer made from a first resin, said first resin made in the presence of a single site catalyst, said first resin having a polydispersity of from about 1 to about 4, a melt index of from about 0.2 to about 20 g/10 min., and a melt flow ratio ($I_{20}/I_2$) of from about 12 to about 35, a second layer comprising a low density polyethylene.

2. The plastic bag of claim 1 wherein said first resin is a polyethylene.

3. The plastic bag of claim 2 wherein said first resin is a linear low density polyethylene.

4. The plastic bag of claim 1 wherein said first resin is a copolymer of ethylene and at least one alpha olefin.

5. The plastic bag of claim 1 wherein said single site catalyst is a metallocene catalyst.

6. The plastic bag of claim 1 wherein said first resin has a density of from about 0.85 to about 0.94 g/cm$^3$.

7. The plastic bag of claim 6 wherein said first resin has a density of from about 0.88 to about 0.920 g/cm$^3$.

8. The plastic bag of claim 1 wherein said first resin has a polydispersity of from about 1.5 to about 4.

9. The plastic bag of claim 8 wherein said first resin has a polydispersity of from about 2 to about 4.

10. The plastic bag of claim 1 wherein said first resin has a melt flow ratio of from about 14 to about 35.

11. The plastic bag of claim 10 wherein said first resin has a melt flow ratio of from about 15 to about 18.

12. The plastic bag of claim 1 wherein said first resin has a melt index of from about 1 to about 17 g/10 min.

13. The plastic bag of claim 1 wherein said first layer of said first panel comprises from about 5 weight percent to about 100 weight percent of said first resin.

14. The plastic bag of claim 13 wherein said first layer of said first panel comprises from about 10 weight percent to about 100 weight percent of said first resin.

15. The plastic bag of claim 1 wherein said first layer of said first panel comprises from about 5 to about 25 weight percent of said first resin.

16. The plastic bag of claim 15 wherein said first layer of said first panel comprises from about 6 to about 10 weight percent of said first resin.

17. The plastic bag of claim 1 wherein said first body panel comprises two layers.

18. The plastic bag of claim 17 wherein said second body panel is made from the same material as said first body panel.

19. The plastic bag of claim 1 wherein said first layer is made from a blend of the first resin and a second resin.

20. The plastic bag of claim 1 further including a zipper, said zipper having a male and female track, said male track including a male profile and a first fin, said first fin being affixed to said first panel in proximity to said top of said first panel, said female track including a female profile and a second fin, said second fin being affixed to said second panel in proximity to said top of said second panel, said male and female profiles having complementary cross-sections.

21. A plastic bag comprising:

a first and second body panels each having a top, a bottom, and first and second opposing sides, said first and second panels being joined to each other along their respective bottoms, their respective first opposing sides, and their respective second opposing sides, said panels comprising two polymeric film layers, a first layer made from a resin prepared in the presence of a single site catalyst, said resin having a polydispersity of from about 1 to about 4, a melt index of from about 0.2 to about 20 g/10 min., and a melt flow ratio ($I_{20}/I_2$) of from about 12 to about 35, a second layer comprising a low density polyethylene.

22. The plastic bag of claim 21 wherein said resin is a polyethylene.

23. The plastic bag of claim 21 wherein said single site catalyst is a metallocene catalyst.

24. The plastic bag of claim 21 wherein said resin has a density of from about 0.85 to about 0.94 g/cm$^3$.

25. The plastic bag of claim 21 wherein said resin has a polydispersity of from about 2 to about 4.

26. The plastic bag of claim 21 wherein said resin has a melt flow ratio of from about 15 to about 18.

27. The plastic bag of claim 21 wherein said first layer of said first panel comprises from about 5 weight percent to about 100 weight percent of said resin.

28. The plastic bag of claim 27 wherein said first layer of said first panel comprises from about 5 to about 25 weight percent of said resin.

29. The plastic bag of claim 28 wherein said first layer of said first panel comprises from about 6 to about 10 weight percent of said first resin.

30. The plastic bag of claim 21 wherein said first layer is made from a blend of said resin and a second resin.

31. The plastic bag of claim 30 wherein at least one of said body panels is prepared by coextruding the first layer and the second layer.

32. The plastic bag of claim 21 further including a zipper, said zipper having a male and female track, said male track including a male profile and a first fin, said first fin being affixed to said first panel in proximity to said top of said first panel, said female track including a female profile and a second fin, said second fin being affixed to said second panel in proximity to said top of said second panel, said male and female profiles having complementary cross-sections.

33. A plastic bag comprising:

first and second body panels each having a top, a bottom, and first and second opposing sides, said first and second panels being joined to each other along their respective bottoms, their respective first opposing sides, and their respective second opposing sides, wherein each of said first and second panels comprises at least two coextruded polymeric film layers, a first layer made from a first resin, said first resin made in the presence of a metallocene-catalyst, said first resin having a polydispersity of from about 1 to about 4, a melt index of from about 0.2 to about 20 g/10 min., and a melt flow ratio ($I_{20}/I_2$) of from about 12 to about 35, and a second layer comprising a low density polyethylene or a blend of said low density polyethylene and a linear low density polyethylene.

34. A multi-layer co-extruded plastic sheet, comprising:

a first layer made from a first resin, said first resin made in the presence of a single site catalyst, said first resin having a polydispersity of from about 1 to about 4, a melt index of from about 0.2 to about 20 g/10 min., and a melt flow ratio ($I_{20}/I_2$) of from about 12 to about 35, and a second layer comprising a low density polyethylene.

35. The multi-layer sheet of claim 34 wherein said first resin is a polyethylene.

36. The multi-layer sheet of claim 34 wherein said first resin is a copolymer of ethylene and at least one alpha olefin.

37. The multi-layer sheet of claim 34 wherein said single site catalyst is a metallocene catalyst.

38. The multi-layer sheet of claim 34 wherein said first resin has a density of from about 0.88 to about 0.920 g/cm$^3$.

39. The multi-layer sheet of claim 34 wherein said first resin has a polydispersity of from about 1.5 to about 4.

40. The multi-layer sheet of claim 34 wherein said first resin has a melt flow ratio of from about 14 to about 35.

41. The multi-layer sheet of claim 34 wherein said first layer of said plastic sheet comprises from about 5 weight percent to about 100 weight percent of said first resin.

42. The multi-layer sheet of claim 41 wherein said first layer of said plastic sheet comprises from about 10 weight percent to about 100 weight percent of said first resin.

43. The multi-layer sheet of claim 41, wherein said first layer of said plastic sheet comprises from about 5 to about 25 weight percent of said first resin.

44. The multi-layer sheet of claim 43 wherein said first layer of said plastic sheet comprises from about 6 to about 10 weight percent of said first resin.

45. The multi-layer sheet of claim 34 comprising exactly two layers.

* * * * *